US005383981A

United States Patent [19]

de Pruneda

[11] Patent Number: 5,383,981

[45] Date of Patent: Jan. 24, 1995

[54] REUSABLE CRUCIBLE FOR CONTAINING CORROSIVE LIQUIDS

[75] Inventor: Jean A. H. de Pruneda, Livermore, Calif.

[73] Assignee: The United States of America as represented by the United States Department of Energy, Washington, D.C.

[21] Appl. No.: 76,061

[22] Filed: Jun. 14, 1993

[51] Int. Cl.[6] ..... C22C 27/00

[52] U.S. Cl. ..... 148/237; 148/206; 420/427

[58] Field of Search ..... 148/237, 206; 420/427

[56] References Cited

U.S. PATENT DOCUMENTS

| | | | |
|---|---|---|---|
| 2,890,110 | 6/1959 | Baker | 75/397 |
| 2,894,832 | 7/1959 | Magel | 75/84.1 |
| 2,908,563 | 10/1959 | Weissman et al. | 75/84.1 |
| 3,163,563 | 12/1964 | Douglass et al. | 420/427 |
| 3,266,948 | 8/1966 | McGuire | 148/237 |
| 3,328,017 | 6/1967 | Conner | 266/275 |
| 3,379,520 | 4/1968 | Chang et al. | 420/427 |
| 3,486,979 | 12/1969 | Wohlberg | 420/427 |
| 3,660,075 | 5/1972 | Harbur et al. | 75/396 |
| 3,715,204 | 2/1973 | DeGrazio et al. | 164/131 |
| 3,802,847 | 4/1974 | Hara et al. | 423/440 |
| 3,804,939 | 4/1974 | Strickland et al. | 75/396 |
| 4,235,629 | 11/1980 | Marsh et al. | 420/427 |
| 4,459,153 | 7/1984 | Mullins et al. | 75/397 |

OTHER PUBLICATIONS

Roy et al, Part I of Doctoral Dissertation Z. Metallkde, 57 (1966) 682–687.

Roy et al, Part II, Doctoral Dissertation Z. Metallkde, 57 (1966) 732–736.

Roy et al, Part III, Doctoral Dissertation Z. Metallkde, 57 (1966) 808–811.

Fromm et al Jour. Less-Common Metals 8 (1965) 73–75.

Hoerz, G. Met Trans. 3A (1972) 3069.

Roy, U. Acta Met. 16 (1968) 243.

Hoerz, G. Metall 27 (1973) 680.

Schulze et al Jour. of Metals, Oct 1988, pp. 25–31.

Hoerz, G. Jour. Less-Common Metals, 100 (1984) 249–275.

Fromm et al. Met. Trans 3A (1972) 1685–1692.

"Development and Evaluation of Carburized Tantalum for Liquid Plutonium Containment" by Bronson et al., abstract presented at the American Ceramics Society Conference, Apr. 12–16, 1992.

"Tantalum–Carbon Alloys for Molten Plutonium Containment" by Gdowski et al., abstract presented at the 12th Annual Pyrochemical Workshop, Oct. 26–29, 1992.

*Primary Examiner*—Upendra Roy

*Attorney, Agent, or Firm*—Henry Sartorio; Roger S. Gaither; William R. Moser

[57] ABSTRACT

A reusable, non-wetting, corrosion-resistant material suitable for containment of corrosive liquids is formed of a tantalum or tantalum alloy substrate that is permeated with carbon atoms. The substrate is carburized to form surface layers of TaC and $Ta_2C$, and then is heated at high temperature under vacuum until the carbon atoms in the carbide layers diffuse throughout the substrate to form a solid solution of carbon atoms randomly interspersed in the tantalum or tantalum alloy lattice.

4 Claims, 5 Drawing Sheets

TaC THICKNESS, cm

REUSABLE CRUCIBLE FOR CONTAINING CORROSIVE LIQUIDS

The United States Government has rights in this invention pursuant to Contract No. W-7405-ENG-48 between the United States Department of Energy and the University of California for the operation of Lawrence Livermore National Laboratory.

BACKGROUND OF THE INVENTION

Field of the Invention

The present invention relates to materials that are useful for the containment of corrosive liquids, and more particularly to a carbon-permeated tantalum substrate and a method for its preparation.

Description of Related Art

Containment of corrosive liquids such as liquid metals and molten salts presents a challenge for material scientists. A variety of metallic and ceramic materials have been used conventionally for containment of corrosive materials like actinide metals. For example, U.S. Pat. No. 2,890,110 discloses crucible liners made of magnesium oxide or calcium oxide. U.S. Pat. No. 4,459,153 also uses magnesia crucibles. U.S. Pat. No. 3,328,017 discusses refractory crucibles composed of magnesium oxide, calcium fluoride, calcium oxide, or a mixture of CaO and $CaF_2$. U.S. Pat. No. 2,894,832 uses a beryllium oxide crucible. U.S. Pat. No. 3,660,075 discloses graphite crucibles coated with niobium carbide or yttrium oxide.

Crucible materials have also included pure tantalum and carburized tantalum having surface layers of tantalum carbide (TaC and $Ta_2C$). In particular, U.S. Pat. No. 3,804,939 teaches the use of a tantalum crucible. U.S. Pat. No. 2,908,563 discloses crucibles of graphite and tantalum. U.S. Pat. No. 3,715,204 discloses a crucible made of tantalum and a method for forming hydrides at the interface of the crucible and the product to dislodge the product material.

Tantalum crucibles have several disadvantages though, particularly in containing liquid actinide metals undergoing processing. The molten metals wet the surfaces of the crucible, which leads to chemical and mechanical corrosion of the crucible. The corrosive liquid adheres to the crucible surfaces, attacks the grain boundaries of the crucible material, penetrates along the grain boundaries, and eventually detaches grains of crucible material that can dissolve in and contaminate the liquid. This corrosion causes the crucible to become brittle and eventually to break. The wetting of the crucible by the liquid metal also hinders the removal of the cooled product.

Because of this wetting problem, tantalum containers are often carburized to form more resistant tantalum carbide surface layers. These surface coatings do not remain bonded to the substrate, however, but are stressed during cooling of the melt. A cooled, solidified material like plutonium, for example, has a thermal expansion coefficient quite different from the container material, which causes the layers of tantalum carbide to fracture and rip off during cooling and removal of the solid.

The corrosion and delamination of the tantalum containers prevent their being used for long periods of time or reused over several thermal cycles. Continual replacement of tantalum containers is expensive and may be inefficient. Therefore, a container material is needed that is wettable by corrosive liquids, heat- and corrosion-resistant, and reusable over at least several processing cycles. The materials should have low solubility in the corrosive liquids, be readily fabricable into containers, and lack the weak, vulnerable coatings that fracture during use.

SUMMARY OF THE INVENTION

The present invention is a composition of matter for containing corrosive liquids and a method for making the composition. A tantalum or tantalum alloy substrate is carburized to form outer surface layers of TaC and $Ta_2C$, and then the substrate is heated under vacuum to drive the carbon atoms from the carbide layers into and throughout the substrate. The tantalum substrate is typically saturated with carbon atoms, which are interspersed in the lattice of metal atoms.

The carbon-permeated tantalum is significantly more resistant to attack by corrosive liquids like salts or metals. The tantalum-carbon alloy resists wetting and is reusable over many thermal cycles. This material can be machined to form containment vessels or crucibles, or other processing parts such as stirrers, plates, sheets, rods, and cylinders.

DETAILED DESCRIPTION OF THE INVENTION

The present invention is a composition of matter suitable as a containment material for corrosive liquids, such as molten salts and metals, and the process for making the material. The composition is a tantalum or tantalum alloy substrate that is permeated with carbon atoms to form a solid solution. The solid solution is a substantially homogeneous crystalline phase comprising tantalum and carbon, where carbon atoms occupy the spaces at random between the lattice points of tantalum, and the carbon can be present in a range of concentrations. This material resists corrosion and wetting by corrosive molten materials, and lacks the tantalum carbide coatings (TaC and $Ta_2C$) that can become detached from the tantalum substrate during cooling and removal of the product. The tantalum-carbon alloy material is reusable over many processing cycles.

General Description

Figure 1:
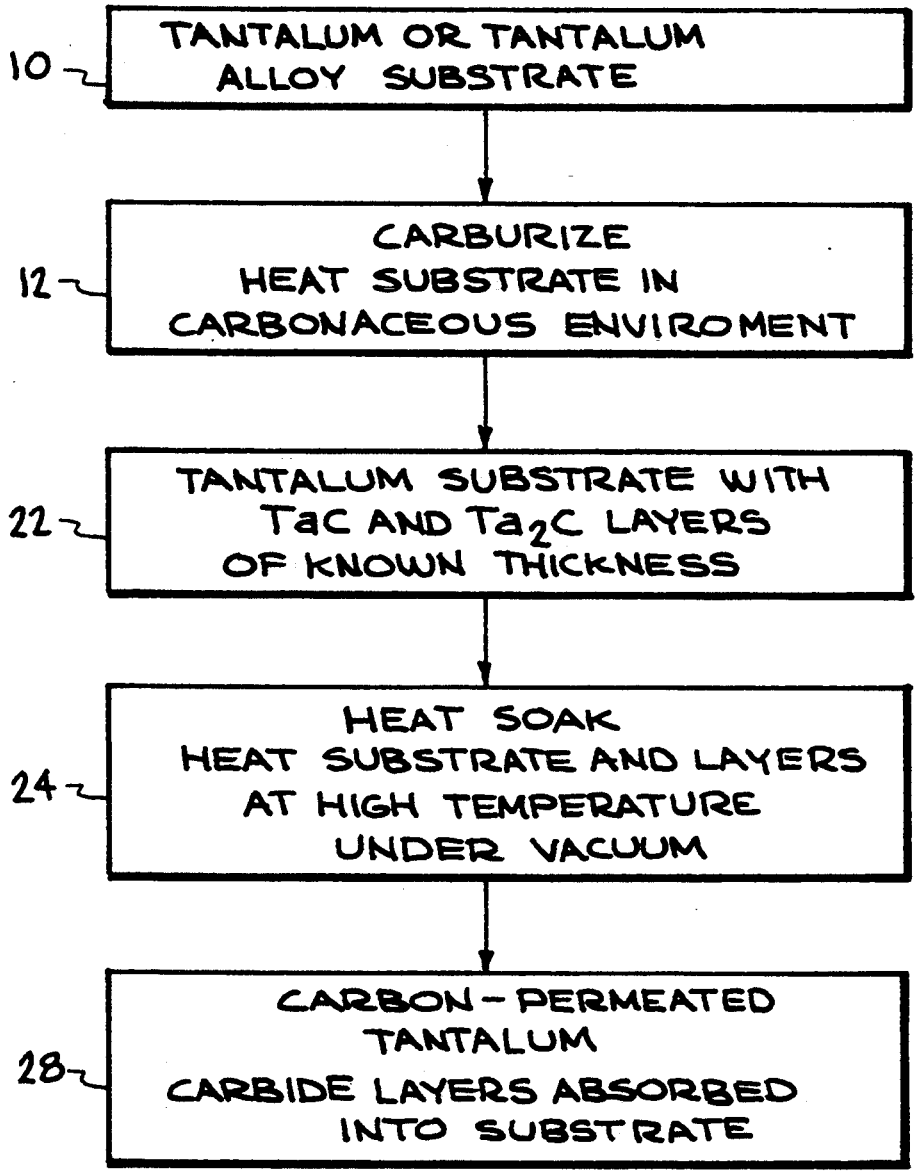
FIG. 1 is a flowchart of the method of making carbon-permeated tantalum.
Figure 2:
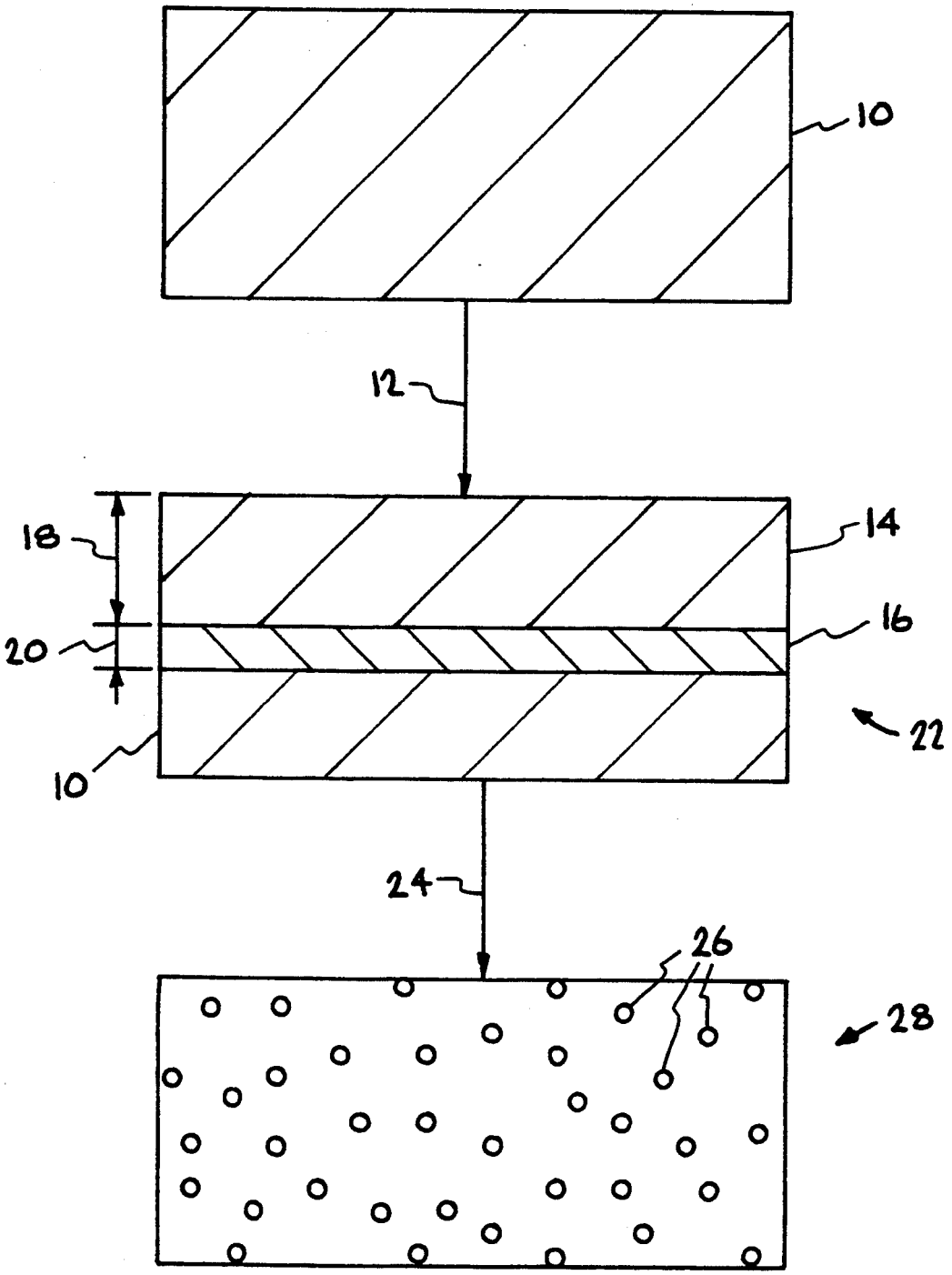
FIG. 2 is a schematic of the preparation of a carbon-permeated tantalum substrate.

FIG. 1 is a flowchart showing the method for forming the carbon-permeated tantalum. The process is also illustrated schematically in FIG. 2. A tantalum or tantalum alloy substrate 10 is heated in a carbonaceous environment 12, or carburized, which forms surface layers of TaC 14 and $Ta_2C$ 16 on the substrate 10. The tantalum carbide layers 12,14 are grown to known thicknesses 18,20. FIG. 2 illustrates the relative thicknesses 18,20 of TaC to $Ta_2C$ (3:1).

The layered substrate 22 is removed from the carbonaceous environment and then heated under vacuum 24 until the carbon atoms 26 diffuse from the TaC 14 and $Ta_2C$ 16 layers to permeate the entire substrate 28. The thickness of the carbide layers 14,16 will determine the degree of saturation of the carbon-permeated tantalum substrate 28. The carbon may form microcarbides at the grain boundaries of a supersaturated tantalum substrate.

Detailed Description

The initial substrate 10 is formed of pure tantalum metal or a tantalum alloy, such as tantalum-niobium or tantalum-tungsten. These metals are particularly useful for containment of plutonium during its processing because of their low solubility in plutonium. Also, a tantalum substrate is desirable because the carbon in a carburized tantalum container remains in the tantalum and does not easily leach out into the molten metal during heating. Tantalum has a very high melting temperature (2996° C.) and is easily fabricated into containers and other processing parts, including crucibles, plates, rods, cylinders, walls, stirrers, or any form that is needed in trapping or working with a corrosive liquid.

The tantalum or tantalum alloy substrate is carburized to form TaC and $Ta_2C$ surface layers of a known thickness, which are then heated under vacuum until the carbon atoms in the carbide layers diffuse throughout the tantalum substrate. The amount of carbon that can dissolve in and saturate a known mass of tantalum is calculated using a tantalum-carbon phase diagram, shown in FIG. 3. Regions are indicated in the diagram where solid phases exist for tantalum 30, $Ta_2C$ 32, and TaC 34.

A range of carbon concentrations is possible in the final tantalum-carbon alloy. Typically, the mass of carbon deposited on the substrate in the carburization process is the amount needed to just saturate the tantalum substrate. However, the substrate may be less than saturated with carbon and still be an effective non-wetting, corrosion-resistant material. The final composition may also be supersaturated with carbon, with carbides in the grain boundaries. The important consideration is that no surface coating of carbides exist on the final substrate that can be easily separated from the container by the corrosive liquid. A less-than-saturated tantalum substrate will be ineffective when the carbon is absent at so many grain boundaries that the corrosive liquid wets the tantalum and is not inhibited from attacking the grains. This exact threshold of undersaturation has not been determined.

Figure 4:
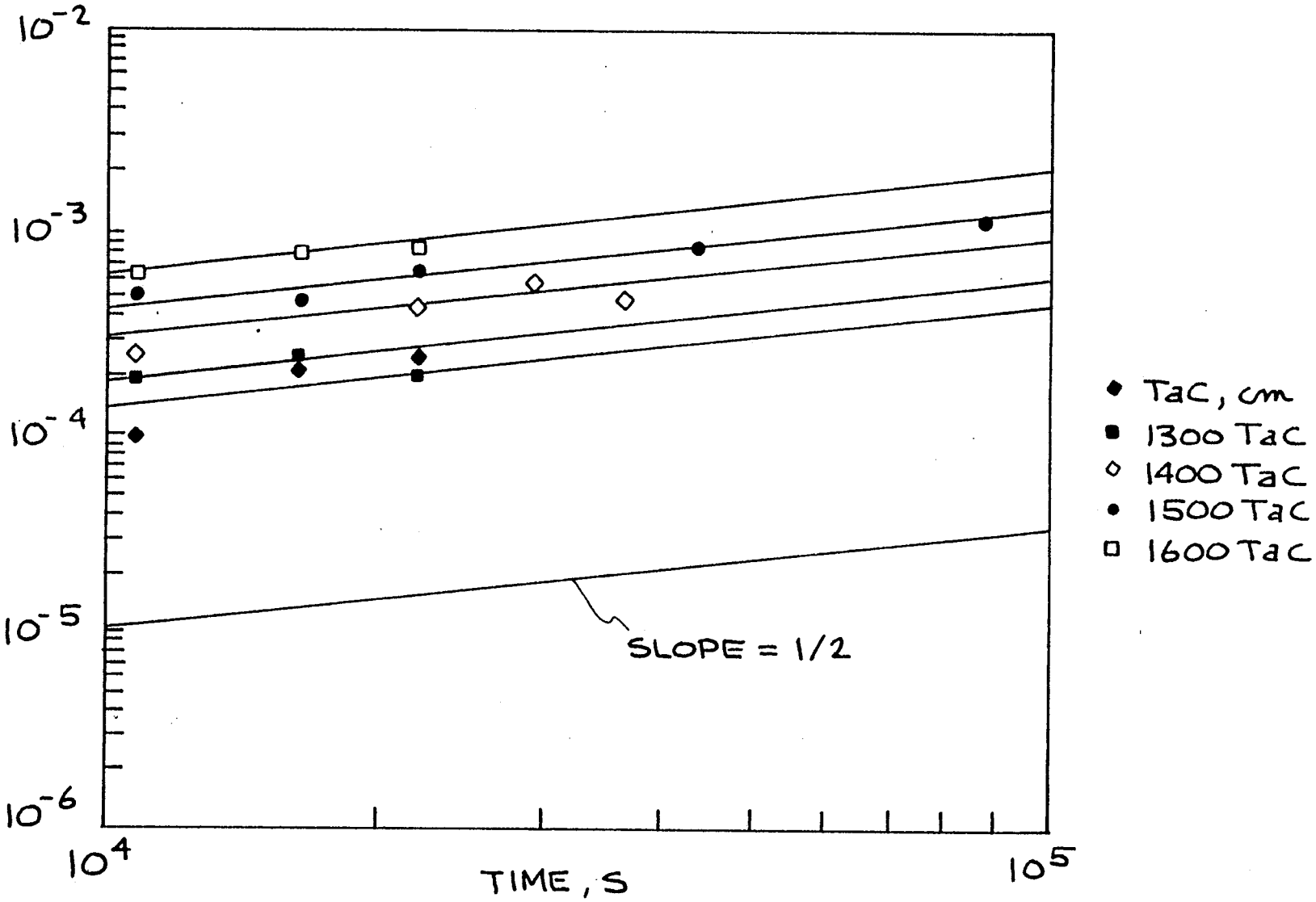
FIG. 4 is a graph of the TaC layer thickness grown versus time at various temperatures.
Figure 5A:
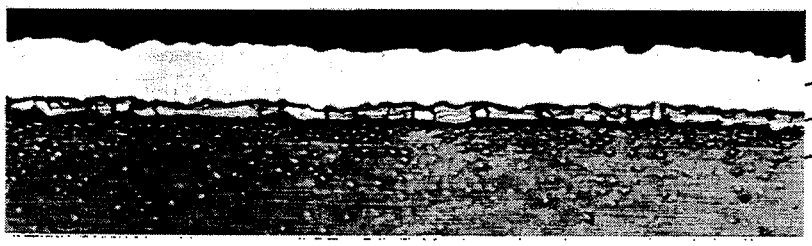
FIG. 5 shows the transformation of TaC and $Ta_2C$ layers during the heat treatment of the present method.
Figure 5B:
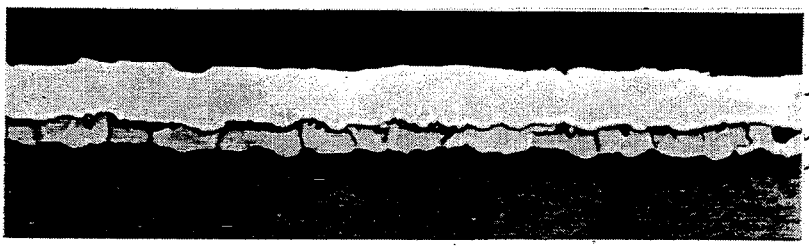
Figure 5C:
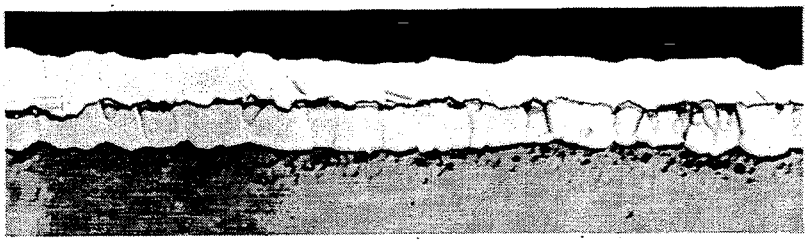
Figure 5D:
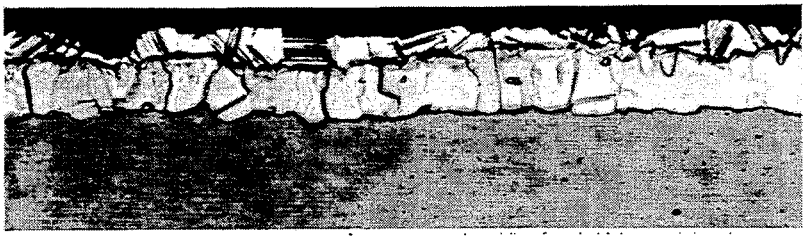
Figure 5E:
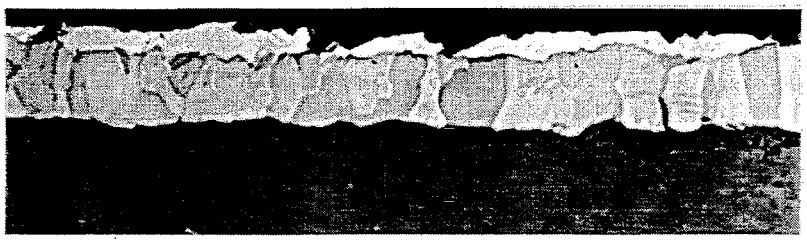
Figure 5F:
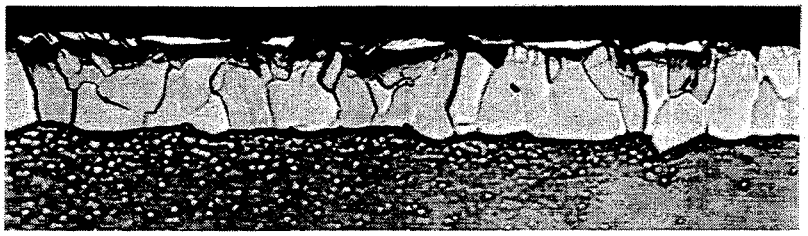

The thicknesses of the TaC and $Ta_2C$ layers that will contain the mass of carbon to be diffused into the substrate are calculated. The tantalum carbides form layers with a thickness ratio of about 3TaC:1$Ta_2C$. The formation of tantalum carbide layers is dependent on time and temperature, based on known relationships. In particular, the growth of TaC and $Ta_2C$ layers is parabolic:

$$W=\sqrt{Kt},$$

where W is the thickness of a carbide layer (TaC or $Ta_2C$), t is time, and K is a function of temperature and the activation energy for the carbide layer. The activation energies determined for TaC and $Ta_2C$ are about 37 kcal and 25 kcal in the temperature range of 1200° C.–1600° C. FIG. 4 is a graph showing TaC layer thickness as a function of time at various temperatures. From a graph such as FIG. 4, one can determine the time needed at a given temperature to grow TaC and $Ta_2C$ layers of the appropriate thickness on a substrate of tantalum.

In this carburization step, the tantalum substrate is typically placed into a carbonaceous environment at ambient temperature and brought up to a temperature of between 1000° C. and 1700° C. in 2–3 hours. Methane gas is usually the source of carbon, but solid carbon placed proximate to the substrate or acetylene gas can also be used as a carbon source. The methane is mixed with an inert carrier gas such as argon to produce an environment of up to 5% methane. (The use of a nitrogen carrier gas may produce nitride or carbonitride layers, which are also protective coatings.) The peak temperature, typically about 1600° C., is usually maintained for 2–8 hours, but may be held longer to grow thicker layers of TaC and $Ta_2C$ for larger containers.

The methane environment is removed, and the carbide-coated tantalum substrate is heated under vacuum. The time needed for this "heat-soak" step is determined by calculations based on the diffusion coefficient for the diffusion of carbon atoms through the tantalum carbide layers for a given temperature and substrate thickness. The objective of the heat treatment is to diffuse the carbon throughout the tantalum substrate, and to absorb and eliminate the vulnerable TaC and $Ta_2C$ layers. Given enough time, the small carbon atoms diffuse throughout the large tantalum (and possibly other metal alloy) atoms to form a solid solution of carbon atoms interspersed among the metal atoms. The carbon atoms may be more concentrated at the grain boundaries, especially at higher carbon concentrations, which causes the formation of fine carbide precipitates within the tantalum grains. The heat treatment also results in significant grain growth. The enhanced resistance of the tantalum-carbon alloy may be due to the presence of continuous carbides on the tantalum grain boundaries.

FIG. 5 shows the transformation of the TaC 50 and $Ta_2C$ 52 layers as the tantalum substrate 54 is heated under vacuum at 1600° C. FIG. 5A shows the carbide layers 50,52 after carburization for six hours at 1600° C. FIGS. 5B through 5F show the carbide layers 50,52 at time intervals of three hours during the high temperature vacuum annealing (or heat-soak) process. The carbon from the carbide layers 50,52 is gradually driven into the bulk of the tantalum substrate 54, shown by the thinning of the carbide layers and growth of the tantalum grains. The $Ta_2C$ layer is still present in FIG. 5F, but the figure illustrates the absorption of carbide surface layers into the tantalum substrate. Continued heating under vacuum will eventually eliminate all traces of discrete, exposed carbide layers.

EXAMPLE I—TANTALUM-CARBON CRUCIBLE

The starting material is a tantalum crucible having a mass of 100 grams. The crucible is a right cylinder with an outside diameter of 2.54 cm, a wall thickness of 0.287 cm, and a height of 2.54 cm. The mass of carbon needed to saturate this tantalum crucible with carbon must first be calculated.

Figure 3:
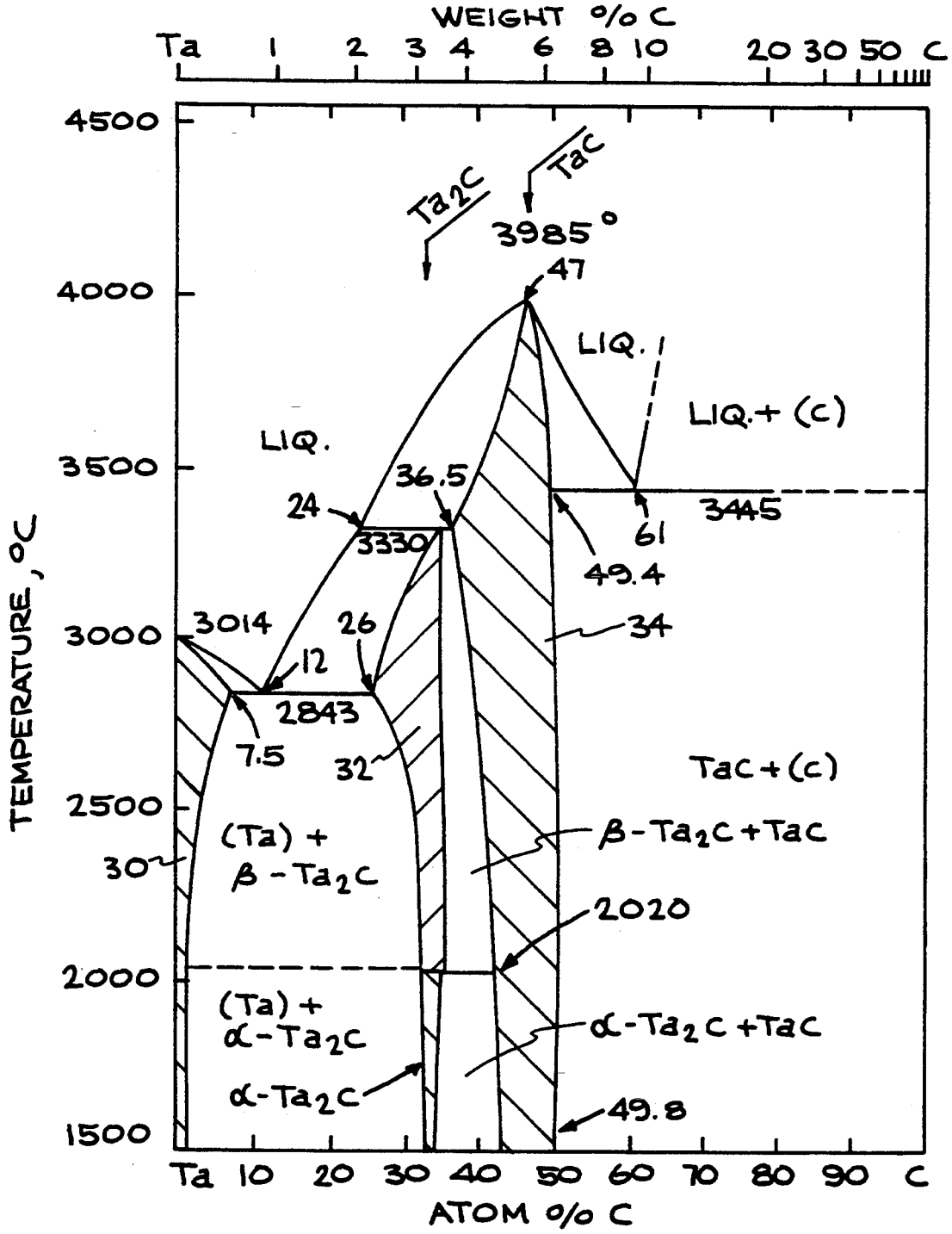
FIG. 3 is a tantalum-carbon phase diagram.

The solubility of carbon in tantalum is obtained from the phase diagram in FIG. 3 and is 1 atomic % or 0.067 wt % at temperatures of 1600° C. and below. Therefore, for a crucible of 100 grams, the mass of carbon required to saturate the tantalum with carbon is 0.067 grams. We now calculate the thicknesses of the TaC and $Ta_2C$ layers that must be grown so that all the carbon in the layers diffuses into and saturates the tantalum crucible during the vacuum heat-soak step.

The surface area of the crucible with the given dimensions is 42.29 $cm^2$. In TaC, the weight percentage of carbon is 6.22 wt % (i.e., 12 grams C/193 grams TaC).

Similarly, the weight percentage of carbon in $Ta_2C$ is 3.21 wt %. If the subscript (1) denotes TaC and the subscript (2) denotes $Ta_2C$, then $$[1]\ 0.0622\ m_1+0.0321\ m_2=0.067,$$

where $m_1$=mass of TaC in grams, and $m_2$=mass of $Ta_2C$ in grams.

The relationships between mass (m), $\rho$ (density), volume (V), thickness (t), and surface area (A), $$m=\rho V, \text{ and}$$

$$V=tA,$$

are used to find an alternative expression for mass:

$$m=t\rho A.$$

Substitution of this expression into equation [1] leads to the equation $$[2]\ 0.0622t_1\rho_1A+0.0321t_2\rho_2A=0.067.$$

The thickness of the TaC layer is three times the thickness of the $Ta_2C$ layer:

$$[3]\ t_1=3t_2.$$

Equation [3] is substituted into equation [2]:

$$[4]\ (0.0622)(3)t_2\rho_1A+0.0321t_2\rho_2A=0.067.$$

The densities of TaC and $Ta_2C$ can be found in the literature:

$$\rho_1=14.47\ g/cm^3, \text{ and}$$

$$\rho_2=14.95\ g/cm^3.$$

After inputting the densities and surface area, Equation [4] reduces to $$114.18t_2+20.29t_2=0.067.$$

The thicknesses of the layers of TaC and $Ta_2C$ are now determinable:

$$t_2=4.98\ \mu m, \text{ and}$$

$$t_1=14.95\ \mu m.$$

The appropriate processing conditions are derived by assuming parabolic growth rates and Arrhenius temperature dependence. Layers of the thicknesses calculated above can be obtained by heating the tantalum crucible at about 1600° C. for approximately 3–4 hours in a 2%–5% methane environment. After the layers of TaC and $Ta_2C$ are grown, the crucible is placed under vacuum and heated at a temperature of about 1600° C. for about 15–20 hours.

The foregoing description of preferred embodiments of the invention is presented for purposes of illustration and description and is not intended to be exhaustive or to limit the invention to the precise form disclosed. The scope of the invention is defined by the following claims.

I claim:

1. A composition of matter for containing corrosive liquid materials, comprising a substrate of tantalum or tantalum alloy supersaturated with carbon atoms, wherein the carbon atoms are interspersed with the tantalum atoms throughout the substrate.

2. A composition of matter as recited in claim 1, wherein the tantalum alloy is selected from the group consisting of tantalum-niobium and tantalum-tungsten.

3. A composition of matter as recited in claim 1, wherein the substrate is formed into a part for processing corrosive liquid materials, selected from the group consisting of crucibles, plates, rods, cylinders, and stirrers.

4. A composition of matter as recited in claim 1 formed by the process comprising:

(a) providing a tantalum or a tantalum alloy substrate, (b) forming carbide layers comprising TaG and $Ta_2C$ on at least one surface or the substrate, and (c) heating the substrate with the carbide layers under vacuum until the carbon atoms in the layers diffuse throughout the substrate.

* * * * *